US011259574B1

(12) United States Patent
Schmidt

(10) Patent No.: US 11,259,574 B1
(45) Date of Patent: Mar. 1, 2022

(54) APPARATUS FOR WEIGHTED APPAREL

(71) Applicant: Capped Out Media, Taylorsville, UT (US)

(72) Inventor: Waynard Schmidt, Taylorsville, UT (US)

(73) Assignee: Capped Out Media, Taylorsville, UT (US)

( * ) Notice: Subject to any disclaimer, the term of this patent is extended or adjusted under 35 U.S.C. 154(b) by 0 days.

(21) Appl. No.: 17/404,929

(22) Filed: Aug. 17, 2021

(51) Int. Cl.
*A41B 1/08* (2006.01)
*A41D 27/24* (2006.01)

(52) U.S. Cl.
CPC ..... *A41B 1/08* (2013.01); *A41D 27/24* (2013.01)

(58) Field of Classification Search
CPC ..... A41B 1/08; A41B 2300/35; A41B 7/08; A41D 27/06; A41D 27/24; A41D 2300/50
USPC ..... 2/231, 232, 273
See application file for complete search history.

(56) References Cited

U.S. PATENT DOCUMENTS 1,085,897 A * 2/1914 Feld ..... A41F 17/00 2/273
1,110,075 A * 9/1914 Morley ..... A41F 17/00 2/273
1,365,731 A * 1/1921 Schloss ..... A41F 17/00 2/273
1,388,802 A * 8/1921 Cooper ..... A41F 17/00 2/273
5,570,474 A * 11/1996 Berry ..... A41D 1/205 2/104
5,782,191 A * 7/1998 Wong ..... B29C 66/729 112/441
6,070,542 A * 6/2000 Wong ..... A41B 3/005 112/441
6,526,597 B1 * 3/2003 Shepard ..... A41F 9/00 2/236
7,861,324 B2 * 1/2011 Chetelat ..... A41C 1/14 2/231
7,900,277 B1 * 3/2011 O'Brien ..... A41F 17/00 2/273
10,625,110 B2 * 4/2020 Henneberry ..... A63B 21/065
2003/0092544 A1 * 5/2003 Reed ..... A63B 21/065 482/105
2003/0135907 A1 * 7/2003 Sanchez ..... A41D 7/005 2/67
2007/0157369 A1 * 7/2007 Uchibori ..... A41D 1/04 2/255
2009/0013445 A1 * 1/2009 Martin ..... A41D 1/04 2/93
2009/0025124 A1 * 1/2009 Gearhart ..... A41F 17/00 2/406

(Continued)

*Primary Examiner* — Alissa L Hoey
(74) *Attorney, Agent, or Firm* — Bochner IP, PLLC; Andrew D. Bochner

(57) ABSTRACT

Provided is a weighted shirt comprising a shirt bottom disposed beneath a shirt body, the shirt bottom comprising an outer bottom and an inner bottom, a bottom stitch configured to join the inner bottom to the outer bottom, and a hem cavity bound by at least the outer bottom, the inner bottom, the inflection point, and the bottom stitch. The weighted shirt may comprise a weight disposed within the hem cavity, where the hem cavity is sized to accept the weight. The weight may be an annular member, where the weight comprises an outer face, an inner face, an upper part, and a lower part.

8 Claims, 5 Drawing Sheets

(56) References Cited

U.S. PATENT DOCUMENTS

| | | | | |
|---|---|---|---|---|
| 2009/0077771 | A1* | 3/2009 | Baba | A41F 17/02 24/72.1 |
| 2009/0100568 | A1* | 4/2009 | Judd | A61H 7/001 2/95 |
| 2010/0064413 | A1* | 3/2010 | Koelle | A63B 21/0603 2/113 |
| 2011/0247127 | A1* | 10/2011 | Pou | A41D 13/0012 2/227 |
| 2013/0017933 | A1* | 1/2013 | Foster | A41D 31/185 482/105 |
| 2013/0227758 | A1* | 9/2013 | Doney | A41B 1/08 2/69 |
| 2015/0196790 | A1* | 7/2015 | Escueta | A63B 21/4007 482/110 |
| 2016/0338414 | A1* | 11/2016 | Siegfried | A41B 1/08 |
| 2017/0157447 | A1* | 6/2017 | Brown | A41D 1/002 |
| 2017/0280780 | A1* | 10/2017 | Janes | A41F 17/00 |
| 2017/0340472 | A1* | 11/2017 | Turner | A41B 1/08 |
| 2018/0132537 | A1* | 5/2018 | Siegfried | A41F 17/00 |
| 2018/0333574 | A1* | 11/2018 | Pal | A61N 1/36034 |
| 2019/0133199 | A1* | 5/2019 | Mirabella | A41B 3/06 |
| 2020/0170435 | A1* | 6/2020 | Hannula | A47H 23/01 |
| 2020/0268307 | A1* | 8/2020 | Ohta | A61B 5/1107 |

* cited by examiner

APPARATUS FOR WEIGHTED APPAREL

FIELD OF INVENTION

The invention is in the field of apparel, specifically apparatuses that enable formfitting apparel free from wrinkles. Further, the invention may be an apparatus that naturally straightens a piece of apparel after unwanted or unintended adherence to one's body.

INTRODUCTION

In many social settings, it is important to have formfitting and wrinkle-free clothes. Unfortunately, professional dry cleaning and laundry services are costly and time intensive. Similarly, for individuals leading typical lives, it is difficult to find time to properly iron and launder clothes. Often, individuals may not have the proper equipment or space to effectively launder their own clothes. For example, professional laundry services may utilize steamers, which are either unobtainable by the average person or too expensive and cumbersome to acquire.

As an alternative, some individuals may search for clothing made from "wrinkle-free" materials. Frequently, however, "wrinkle-free" materials do not work as advertised. For example, "wrinkle-free" materials may remain less wrinkled, but not wrinkle free. Moreover, because "wrinkle-free" materials are a specialized material, clothing utilizing them is often limited in terms of color, design, and appearance.

Moreover, upon sitting down or bending over, one's shirt may become stuck in the fold of one's stomach. Additionally, a shirt may become lodged in one's belt or may otherwise adhere to one's skin (for example, an individual who is sweating). Thus, after standing up, the first reaction of many people is to untuck and straighten their shirt. For many individuals, such a reaction may be tedious, burdensome, or embarrassing.

It would be desirable to have clothing that is wrinkle-free, without the need for specialized equipment and continual laundering. It would also be desirable to have clothing that naturally untucks as a wearer returns to a standing position.

It would further be desirable to have clothing composed of typical materials, where the clothing has a wrinkle-free nature. It would yet further be desirable to have clothing weighted to prevent wrinkles, weighted in a manner where the weight is concealed.

DETAILED DESCRIPTION

Figure 1:
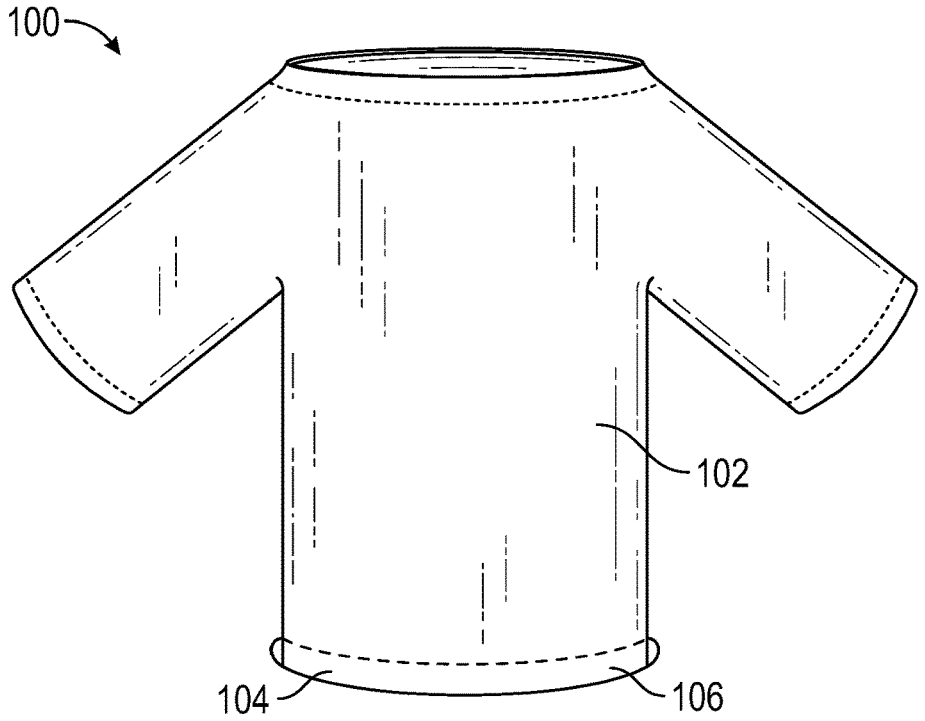
FIG. 1 is an illustration of an embodiment of a shirt with a weighted bottom.

The present invention adds a whole new dimension to formfitting clothing and wrinkleless apparel. In an embodiment, the present invention also adds a new dimension to clothing that may "untuck" itself.

Throughout the specification, wherever practicable, like structures will be identified by like reference numbers. In some figures, components, such as additional electrical connections or fasteners have been omitted for clarity in the drawings. Unless expressly stated otherwise, the term "or" means "either or both" such that "A or B" includes A alone, B alone, and both A and B together.

Referring to FIG. 1, the invention of the present disclosure may be a shirt 100 having a shirt body 102 and a shirt bottom 104. In an embodiment, a weight 106 is disposed on and/or in the shirt bottom 104. The weight 106 may be configured to pull on the fabric (or other material) comprising the shirt body 102. As a non-limiting example, the weight of the weight 106 may apply a downward force on the shirt body 102. In such a non-limiting example, the downward force on the shirt body 102 may manifest as an increased tension in the material of the shirt body 102. Thus, such a tension in the shirt body 102 may reduce wrinkles and increase the formfitting nature of the shirt 100. For example, the increased tension applied to the shirt body 102 may accentuate the muscular definition of the wearer. As another non-limiting example, the increased tension applied to the shirt body may prevent the shirt from "riding up" or from developing wrinkles.

Figure 2A:
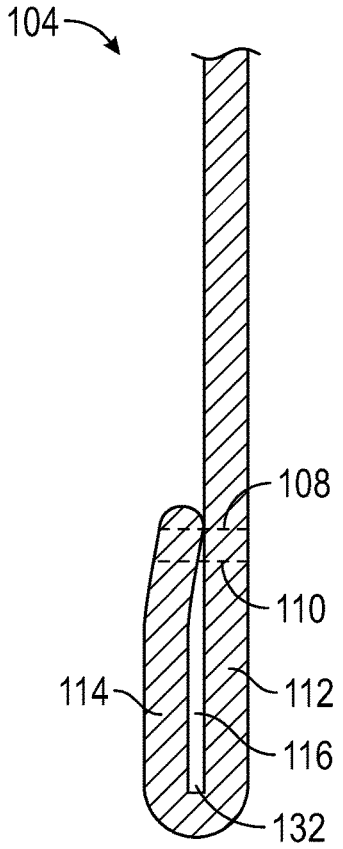
FIGS. 2A-2B are illustrations of a cross section of a shirt bottom.

Referring to FIG. 2A, the shirt bottom 104 may include a top stitch 108 and a bottom stitch 110. In such an embodiment, the plane of the shirt 100 (for example, the shirt body 102) may be folded into the inside of the shirt 100 and fastened to the shirt bottom 104. Further, in such an embodiment, the shirt bottom 104 may be fastened via a top stitch 108 and a bottom stitch 110.

In an embodiment, the shirt bottom 104 may have an outer bottom 112 and an inner bottom 114. The outer bottom 112 may face outward (for example, away from the wearer), while the inner bottom 114 may face inward (for example, towards the wearer). In an embodiment, the outer bottom 112, the inner bottom 114, the bottom stitch 110, and/or the inflection point 132 encapsulate a hem cavity 116.

In an embodiment, the weight 106 may be disposed within the hem cavity 116. In such an embodiment, the hem cavity 116 may be sized to accept the weight 106. In an embodiment, the weight 106 is a hollow annular member. In such an embodiment, the weight 106 may have a weight cavity 118. The weight cavity 118 may be configured to house a weighted material 120.

Figure 2B:
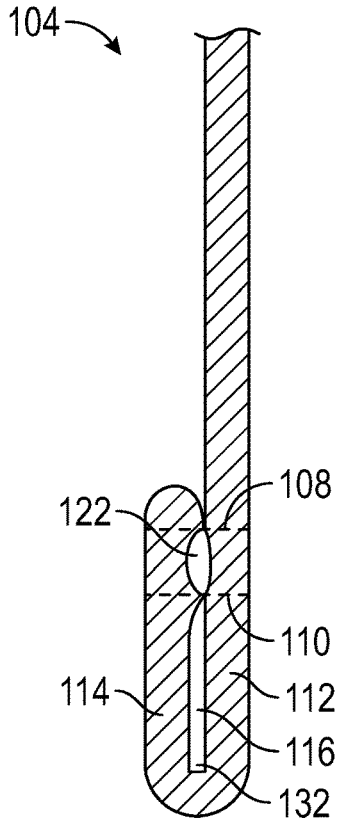

Referring to FIG. 2B, the shirt bottom 104 may include a top stitch 108 and a bottom stitch 110. In an embodiment, a stitch bound cavity 122 may be bound by the top stitch 108, the bottom stitch 110, the outer bottom 112, and the inner bottom 114. In such an embodiment, the weight 106 or weighted material 120 may be disposed within the stitch bound cavity 122. In an embodiment, the shirt bottom 104 includes a stitch bound cavity 122 and a hem cavity 116. However, in an alternate embodiment, the shirt bottom 104 only contains a stitch bound cavity 122.

In an embodiment, the weight 106 does not include a weight cavity 118. In such an embodiment, the weight 106 is a solid annual member. In an embodiment, the weight 106 may be any shape before insertion into the shirt bottom 104. For example, the weight 106 may be flexible, such that the weight 106 adheres to the shape of the shirt bottom 104 after insertion. In an embodiment, the shirt bottom 104 includes a slit (for example, allowing fluid communication between the environment and the hem cavity 116), enabling an individual to feed the weight 106 into the hem cavity 116. The slit may be disposed on the outer bottom 112, the inner bottom 114, or the inflection point 132. In another embodiment, the weight 106 is placed in the hem cavity 116 upon manufacture of shirt 100.

In an embodiment, the weight 106 may be a fabric or other textile material that is lined, infused, or otherwise contains weighted material 120. As a non-limiting example the weight 106 may be composed of woven acrylic, knitted polyester, mink, cotton, fleece, wool, or other similar material. Further, as a non-limiting example, the weighted material 120 may be plastic poly pellets, rubber pellets, small stones, additional fabric, glass beads, steel shot beads, or other similar materials. In an embodiment, the weight 106 may be an annular belt-shaped member. In such an embodiment, the weight 106 may be sized to attach to the inside of the shirt bottom 104 (for example, along the circumference of the shirt bottom 104). In another embodiment, the weight 106 may be disposed within the shirt bottom 104 or on the outside surface of the shirt bottom 104. In an embodiment, the "fabric nature" of this embodiment of weight 106 may act to conceal the weight 106 and may provide comfort to the wearer. In an embodiment, the weighted material 120 may be additional fabric or textile material. For example, the weighted material 120 may be a fabric material with a mass and/or density greater than that of the shirt body 102 material. However, in an alternate embodiment, the weighted material 120 may be one or more additional layers of the same material composing the shirt body 102. In an embodiment, the additional fabric material may be disposed on the shirt bottom 104 in the form of a thin annular strip (for example, a belt shape) along the inside surface of the shirt bottom 104. In an embodiment, the additional layers of fabric may be sewn tightly or compacted such that the weight 106 is sufficiently dense. In such an embodiment, the weight 106 may be sufficiently heavy to impose tension on the shirt body 102, yet sufficiently compact as not to burden the wearer.

Figure 3A:
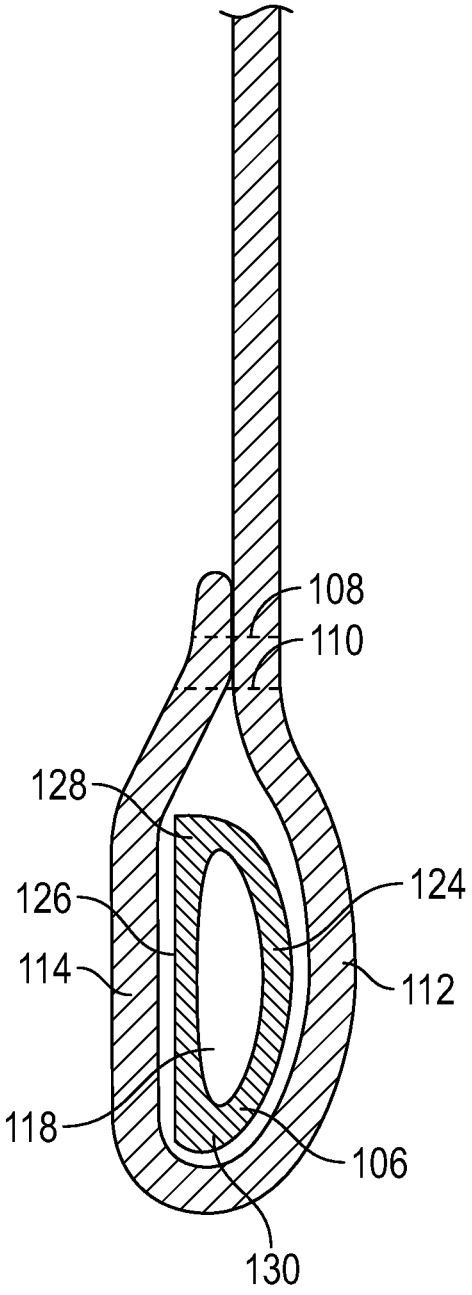
FIGS. 3A-3F are illustrations of embodiments of the shirt bottom accompanied by weight embodiments.

Referring to FIG. 3A, the weight 106 may include an outer face 124 and an inner face 126. The weight 106 may also include an upper part 128 and a lower part 130. The outer face 124 may interface with the inside surface of the outer bottom 112. The inner face 126 may interface with the inside surface of the inner bottom 114. The upper part 128 may interface with the bottom stitch 110. The lower part 130 may interface with the inflection point 132.

In an embodiment, the inner face 126 may be flat. For example, the inner face 126 may be flat, such that it is parallel with the plane of the shirt body 102. In an embodiment, the outer face 124 may be rounded. For example, the outer face 124 may be a semi-circle protruding outward from the wearer.

In an embodiment, the weight 106 includes a weight cavity 118. The weight cavity 118 may be a cavity bound by the inner face 126, the outer face 124, the upper part 128, and the lower part 130. The weight cavity 118 may be a uniform shape throughout the weight 106. For example, the cross section of the weight cavity 118 may be an oval. As another example, the cross section of the weight cavity 118 may a scaled down version of the inner face 126, outer face 124, upper part 128, and lower part 130.

Figure 3B:
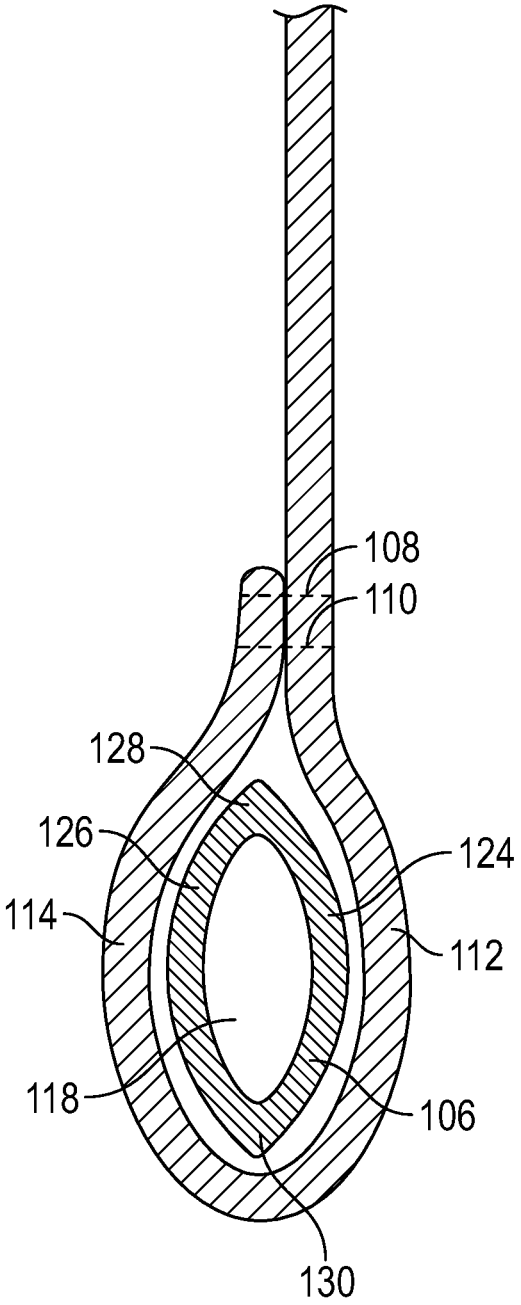

Referring to FIG. 3B, the weight 106 may have a rounded inner face 126 and a rounded outer face 124. In an embodiment, the cross section of the weight 106 may be symmetric about a vertical axis bisecting the cross section of the weight 106. In an embodiment, the cross section of the weight 106 may be a circle. In such an embodiment, the weight 106 may be a torus.

In an embodiment, the inner face 126 and the outer face 124 may be flat. Further, in an embodiment, the upper part 128, and the lower part 130 may be flat. For example, the weight 106 may be a thin annular belt-shaped member. In such an embodiment, the inner face 126 and the outer face 124 may be orthogonal to the upper part 128 and the lower part 130.

Figure 3C:
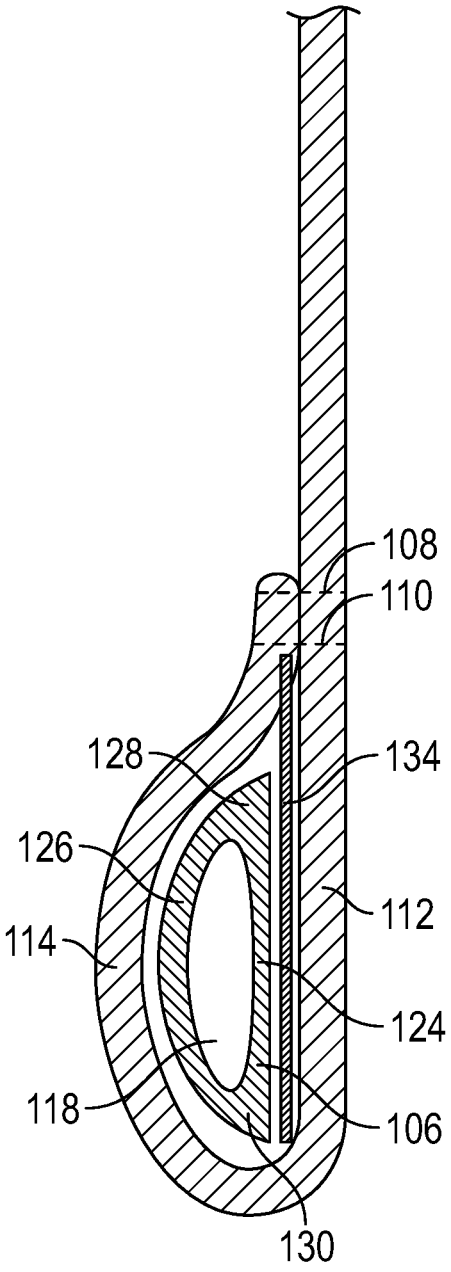

Referring to FIG. 3C, the weight 106 may have a rounded inner face 126 and a flat outer face 124. In an embodiment, a stay surface 134 may be disposed on the outer face 124, the inner face 126, the upper part 128, and/or the lower part 130. Referring to FIG. 3C, a stay surface 134 may be disposed between the outer face 124 and the inside surface of the outer bottom 112. The stay surface 134 may be an annular member with a thin rectangular cross section, for example having a belt shape. The stay surface 134 may be rigid. In an embodiment, the stay surface 134 may maintain a flat appearance to the shirt bottom 104, by preventing the profile of the weight 106 from printing through the shirt bottom 104 fabric. In an embodiment, the stay surface 134 may also maintain the position of the weight 106. In an embodiment, the stay surface 134 may be sewn into the shirt bottom 104. For example, the stay surface 134 may be sewn into the shirt 100 via the top stitch 108 and/or the bottom stitch 110. Alternatively, for example, the stay surface 134 may be attached to the shirt bottom 104 with a stitch other than the top stitch 108 or bottom stitch 110. In an embodiment, the stay surface 134 may extend above the top stitch 108 and/or bottom stitch 110. In another embodiment, the stay surface 134 may extend to, but not traverse, the bottom stitch 110. In an embodiment, the shirt 100 may contain one or more stay surfaces. In such an embodiment, the stay surfaces may be non-annular rigid members disposed at regular intervals around the shirt bottom 104. For example, the stay surfaces may be rigid squares disposed between the outer face 124 and the outer bottom 112 at four equidistant points around the shirt bottom 104.

Figure 3D:
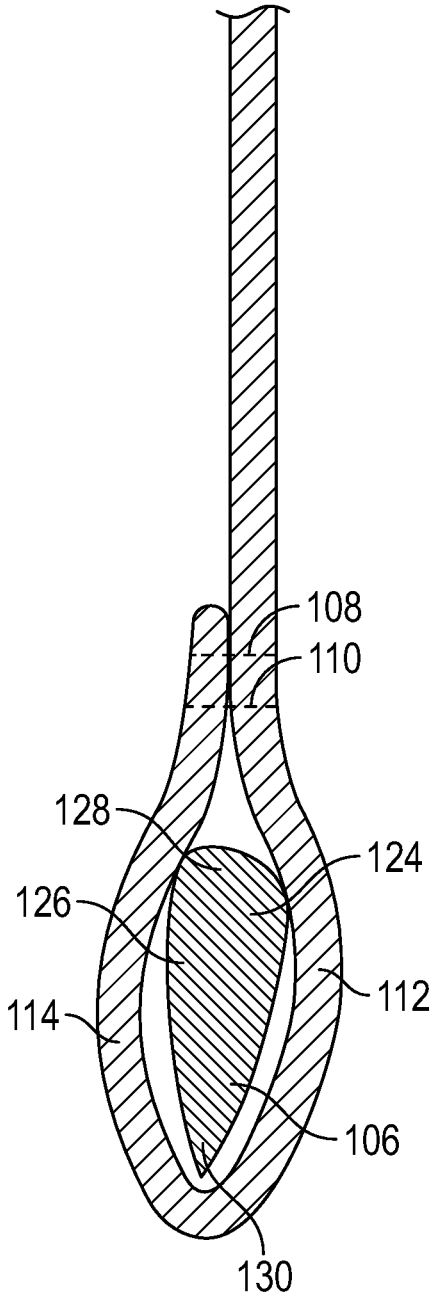

Referring to FIG. 3D, the weight 106 may have a flat inner face 126 and an inverted teardrop outer face 124. In such an embodiment, the mass of the weight 106 may be distributed to the upper part 128 more than the lower part 130. Further, in such an embodiment, as the mass is distributed towards the upper part 128, the weight 106 may be less likely to swing outward or inward at the inflection point 132. Thus, the vertical distribution of mass of, or within, the weight 106 may be modified to prevent the shirt bottom 104 from flaring out.

In an embodiment, any of the weight 106 embodiments may exist within the hem cavity 116. In an alternate embodiment, any of the weight 106 embodiments may exist on the shirt bottom 104, outside the hem cavity 116. In an embodiment, the weight 106 may be disposed on the outside surface of the outer bottom 112. In another embodiment, the weight 106 may be disposed on the outside surface of the inner bottom 114.

Figure 3E:
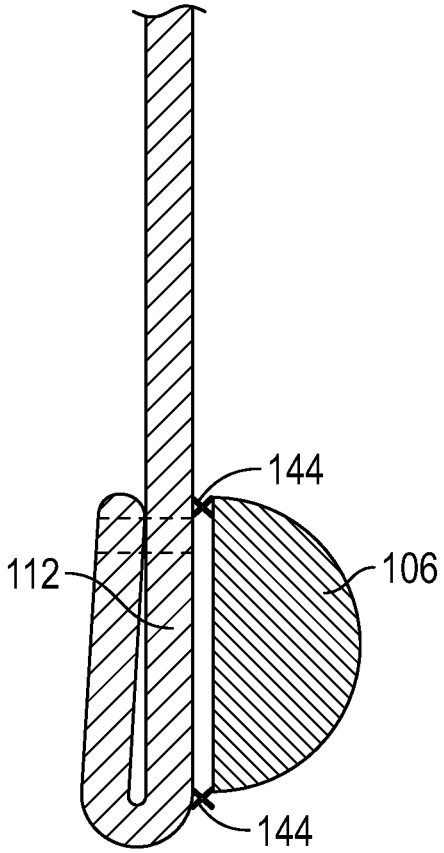

Referring to FIG. 3E, in an embodiment, the weight 106 may be fastened to any of the outside surfaces of the shirt bottom 104. For example, the weight 106 may be sewn or otherwise adhered (for example, with an adhesive) to an outside surface of the shirt bottom 104. In an embodiment, the weight 106 may be attached or partially attached to the shirt bottom 104 via the top stitch 108 and/or bottom stitch 110. As a non-limiting example, during shirt 100 manufacture, the hem may be sewn while the weight 106 is disposed on the shirt bottom 104, such that the weight 106 becomes affixed to the shirt bottom 104.

Figure 3F:
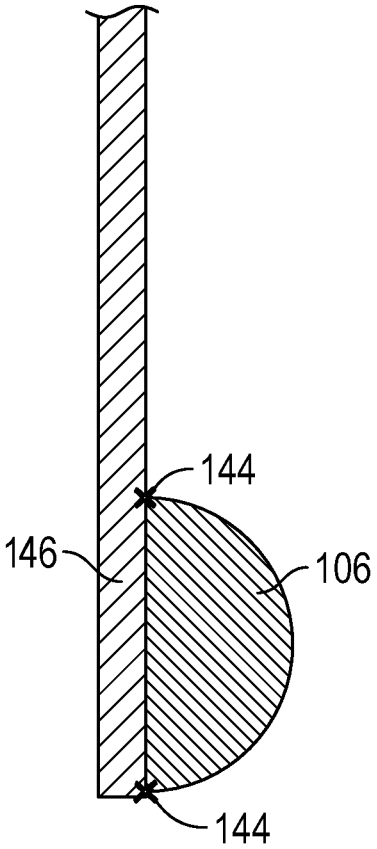

Referring to FIG. 3F, in an embodiment, the shirt bottom 104 may not include an inflection point 132. For example, the fabric may not be draped into itself to form a hem cavity 116. However, in such an embodiment, the weight 106 may be disposed on the single layer bottom 146. In an embodiment, the weight 106 may be attached to the outside surface of the single layer bottom 146 (for example, the side of the shirt 100 facing away from the wearer). Alternatively, the weight 106 may be attached to the inside surface of the single layer bottom 146 (for example, the side of the shirt 100 facing toward the wearer). In such an embodiment, the weight 106 may be concealed to third parties by attaching the weight 106 to the inside surface of the single layer bottom 146. In an embodiment, the weight 106 may be attached to the single layer bottom 146 with one or more outer stitches 144. In another embodiment, the weight 106 may be adhered to the shirt bottom 104 and/or the single layer bottom 146 via an adhesive (for example, a fabric adhesive) or any other means commonly known in the field of tailoring.

In an embodiment, the weight 106 may be encapsulated or partially encapsulated by an outer weight fabric. In such an embodiment, the outer weight fabric may be disposed on any or all of: the outer face 124, the inner face 126, the upper part 128, the lower part 130, the left portion 136, the right portion 138, the front portion 140, and/or the rear portion 142 of the weight 106. In an embodiment, the weight 106 may be attached to the shirt bottom 104 by fastening the outer weight fabric to the shirt bottom 104 (for example, by stitching the shirt bottom 104 to the outer weight fabric and/or by applying an adhesive between the shirt bottom 104 and outer weight fabric). Thus, the weight 106 may be attached to the shirt bottom 104 via the outer weight fabric.

Figure 4A:
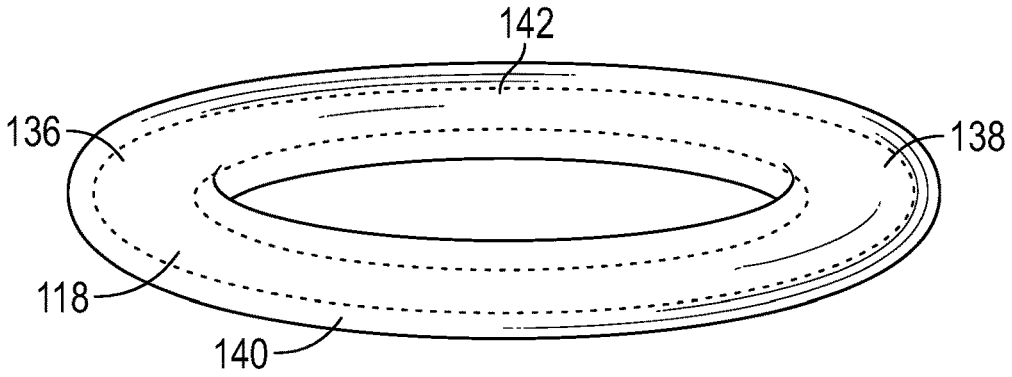
FIGS. 4A-4B are illustrations of weights in annular form.

Referring to FIG. 4A, in an embodiment, the weight 106 may include weighted material 120 following a pre-determined distribution. For example, the weighted material 120 may be more present or more concentrated in the weight left portion 136 and the weight right portion 138. However, in another example, the weighted material 120 may be more present or more concentrated in the weight front portion 140 and the weight rear portion 142. In an embodiment, the distribution of weighted material 120 may be symmetrical (for example, opposite portions of the weight 106 having the same weight distribution), promoting a balanced shirt 100 on the wearer. However, in an alternate embodiment, the distribution of weighted material 120 may be more prevalent on one portion (for example, solely the weight front portion 140).

In an embodiment, the weight cavity 118 may be configured to accept the weighted material 120. For example, an input may be disposed on the weight 106, enabling fluid communication between the weight cavity 118 and the environment. In an embodiment the weighted material may be sand, water or another liquid, metal shavings, steel shot, lead shot, solid granules with liquid-like characteristics when amassed, or any other suitable material. In such an embodiment, the use of solid granules with liquid-like characteristics when amassed (for example, sand or steel shot) may allow for an even distribution of weighted material along the weight 106. Further, in such an embodiment, as the user leans, the weighted material 120 may flow to the portion of the weight cavity 118 in the direction of the user's lean. Thus, in such an embodiment, the weighted material 120 may become more concentrated in a portion of the shirt bottom 104 most likely to become stuck to one's person.

Figure 4B:
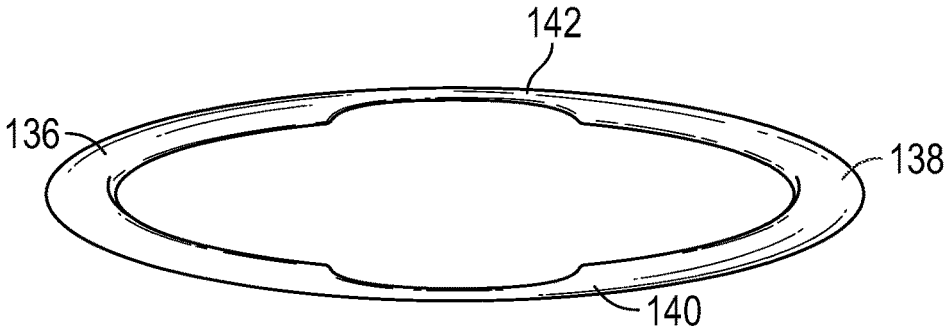

Referring to FIG. 4B, in an embodiment where the weight 106 does not include a weight cavity 118, the shape of the weight 106 may be adjusted to distribute weight in desired positions. For example, the weight left portion 136 and the weight right portion 138 may be narrower than the weight front portion 140 and weight rear portion 142. The weight 106 may also be distributed in a manner to ensure comfort for the wearer. For example, there may be mass distributed away from the front portion 140 if a wearer would prefer less tension on the front of the shirt 100. In an embodiment, the weight 106 may be shaped as to promote comfort for the wearer. For example, the weight front 140 may be narrower than the weight rear 142, such that a user's abdomen does not make uncomfortable contact with the weight front 140.

In an embodiment, the shirt bottom 104 may not include any of the following: the top stitch 108, the bottom stitch 110, the outer bottom 112, and the inner bottom 114. For example, the shirt bottom 104 may be a continuation of the shirt body 102 without an inflection point 132. In such an embodiment, the weight 106 may be disposed on either side of the shirt bottom 104.

The weight 106 may be an annular member with a thin rectangular cross section (for example, akin to a belt). In such an embodiment, the weight 106 may be disposed on the inside of the shirt bottom 104, such that it is concealed from third party view.

In an embodiment, one or more weights 106 may be disposed on various parts of the shirt 100. For example, a weight 106 may be disposed on one or more of the shirt armholes. In such an example, the weight 106 may be disposed to the shirt armhole bottom in a manner similar to how it may be disposed to the shirt bottom 104. In another embodiment, the one or more weights 106 may be disposed on the collar of a shirt.

In an alternate embodiment, the weight 106 may be disposed on the bottom cuff of pants or shorts, the bottom of a jacket or coat, and/or the bottom or rim of a hat. In such alternate embodiments, the weight 106 may be disposed on any apparel in a manner similar to how the weight 106 is configured with the shirt 100.

Figure 5:
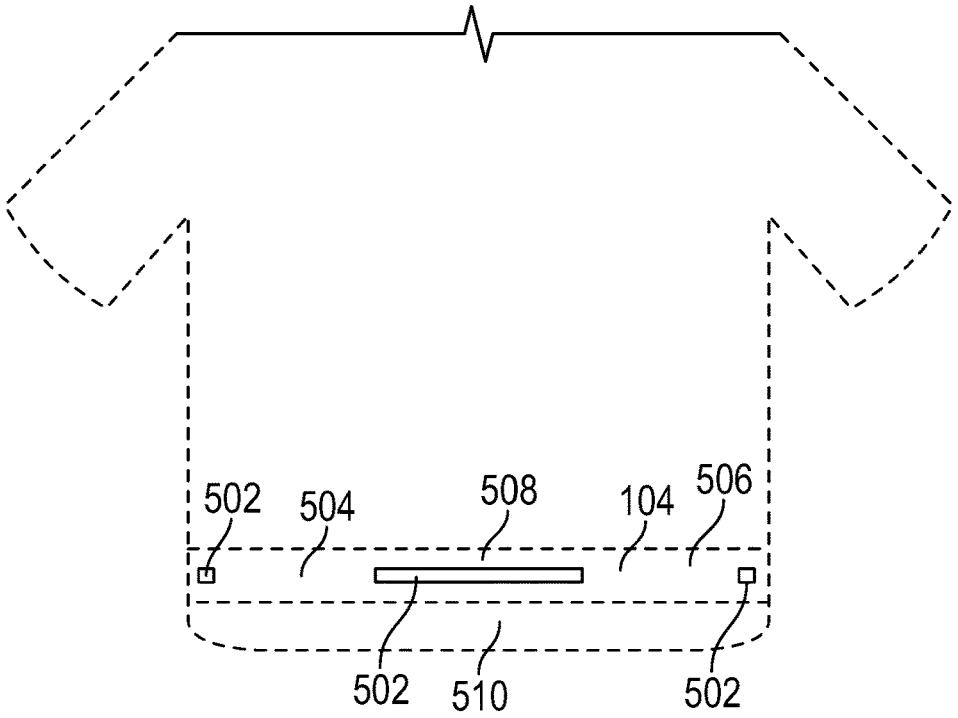
FIG. 5 is an illustration of an embodiment of the shirt including segmented weights.

Referring to FIG. 5, the shirt bottom 104 may include one or more segmented weights 502. The one or more segmented weights 502 may be disposed within the hem cavity 116, the stitch cavity 122, or disposed on the inside or outside surface of the shirt bottom 104. The segmented weights 502 may be of any shape, size, mass, or material. The segmented weights 502 may occupy the shirt bottom 104 in an arrangement similar to that of an annular weight 106. As a non-limiting example, two segmented weights 502 may disposed on the shirt bottom 104, where one weight 502 is disposed at the shirt bottom left 504 and the second weight 502 is disposed at the shirt bottom right 506. In another non-limiting example, as displayed in FIG. 5, two segmented weights 502 of equal mass may be disposed on the shirt bottom left 504 and the shirt bottom right 506, while a third segmented weight 502 of greater mass, may be disposed on the shirt bottom front 508. However, the one or more segmented weights 502 may be disposed along any portion of the shirt bottom 104 (for example, shirt bottom rear 510). Both the placement and mass of the one or more segmented weights 502 may impart a multitude of forces on the shirt body 102. For example, the embodiment, as represented in FIG. 5, may be configured to significantly pull down on the front of the shirt 100 and to pull down the right and left of the shirt 100 to a lesser degree.

In an alternate embodiment, the weight 106 and/or the segmented weights 502 may be removable from the shirt 100. For example, the weight 106 and/or the segmented weights 502 may be equipped with a clip, zipper, hook and loop fastener, adhesive, or other fastener configured to enable attachment and detachment of the weight 106 and/or the segmented weights 502. In such an embodiment, the wearer may customize the position and amount of mass for an intended purpose.

The invention may be a weighted shirt having a shirt bottom disposed beneath a shirt body, where the shirt bottom comprises an outer bottom and an inner bottom, where the shirt body, the outer bottom, and the inner bottom are composed of a continuous material. The shirt bottom may also include an inflection point formed by a vertex of the outer bottom and the inner bottom, and a bottom stitch configured to join the inner bottom to the outer bottom. The shirt bottom may also include a hem cavity bound by at least the outer bottom, the inner bottom, the inflection point, and the bottom stitch, and a weight disposed within the hem cavity, where the hem cavity is sized to accept the weight.

In an embodiment, the weight is an annular member, where the weight further comprises an outer face, an inner face, an upper part, and a lower part. In an embodiment the inner face may be flat and the outer face may be rounded. In an embodiment, the weight houses a weight cavity, where the weight cavity may be configured to accept a weighted material. The weighted material may be sand or water. The shirt bottom may include a stay surface disposed between the outer face and the outer bottom, where the stay surface is an annular member, and where a cross section of the stay surface is a thin tall rectangle. A top stitch may be disposed above the bottom stitch, where the top stitch may be configured to join the inner bottom and the outer bottom. In an embodiment, a weight may be disposed on the inner bottom; and one or more outer stitches configured to attach the weight to the inner bottom.

The invention may be a weighted shirt comprising a shirt bottom disposed beneath a shirt body, where the shirt bottom comprises a single layer bottom, where the shirt body and the single layer bottom are composed of a continuous material. The single layer bottom may have an inner single layer bottom and an outer single layer bottom, where the inner single layer bottom is configured to face toward a wearer and the outer single layer bottom is configured to face away from a wearer. A weight may be disposed on the inner single layer bottom and one or more outer stitches may be configured to attach the weight to the inner bottom. The weight may be an annular member, where the weight comprises an outer face, an inner face, an upper part, and a lower part. The inner face may be rounded and the outer face may be flat.

In an embodiment, the invention of present disclosure may be a weighted shirt comprising a shirt bottom disposed beneath a shirt body, where the shirt bottom comprises an outer bottom and an inner bottom, where the inner bottom is configured to face toward a wearer and the outer bottom is configured to face away from the wearer. The weighted shirt may further comprise a weight disposed on the inner bottom, and one or more outer stitches configured to attach the weight to the inner bottom, where the weight is an annular member. The weight may be a textile material infused with a weighted material. The weighted material may be plastic poly pellets or one or more additional layers of a fabric material.

While certain novel features of the present invention have been shown and described, it will be understood that various omissions, substitutions and changes in the forms and details of the device illustrated and in its operation can be made by those skilled in the art without departing from the spirit of the invention.

What is claimed is:

1. A weighted shirt comprising:

a shirt bottom disposed beneath a shirt body, the shirt bottom comprising:

an outer bottom and an inner bottom, wherein the shirt body, the outer bottom, and the inner bottom are composed of a continuous material;

an inflection point formed by vertex of the outer bottom and the inner bottom;

a bottom stitch configured to join the inner bottom to the outer bottom;

a hem cavity bound by at least the outer bottom, the inner bottom, the inflection point, and the bottom stitch;

a weight comprising an outer face, an inner face, an upper part, and a lower part, the weight disposed within the hem cavity, wherein the hem cavity is sized to accept the weight, wherein the weight is an annular member extending around an entire circumference of the shirt bottom; and a stay surface configured to conceal the weight, the stay surface disposed between the outer face and the outer bottom, wherein the stay surface is a separate structure from the weight, wherein the stay surface is an annular member extending around the entire circumference of the shirt bottom, and wherein the stay surface is taller than the weight.

2. The weighted shirt of claim 1, wherein the inner face is rounded and the outer face is flat.

3. The weighted shirt of claim 2, wherein the inner face is flat and the outer face is rounded.

4. The weighted shirt of claim 1, wherein the weight comprises a weight cavity and a weighted material, the weight cavity configured to accept the weighted material.

5. The weighted shirt of claim 4, wherein the weighted material is sand.

6. The weighted shirt of claim 4, wherein the weighted material is water.

7. The weighted shirt of claim 1, wherein a cross section of the stay surface is a thin tall rectangle.

8. The weighted shirt of claim 1, further comprising a top stitch disposed above the bottom stitch, the top stitch configured to join the inner bottom and the outer bottom.

* * * * *